US007744419B2

(12) United States Patent
Blum et al.

(10) Patent No.: US 7,744,419 B2
(45) Date of Patent: Jun. 29, 2010

(54) APPLIANCE CONNECTOR DEVICE WITH INTEGRATED FILTER MODULE

(75) Inventors: Herbert Blum, Nottwil (CH); Heinz Amrein, Kriens (CH)

(73) Assignee: Schurter AG, Luzern (CH)

( * ) Notice: Subject to any disclaimer, the term of this patent is extended or adjusted under 35 U.S.C. 154(b) by 161 days.

(21) Appl. No.: 12/217,855

(22) Filed: Jul. 9, 2008

(65) Prior Publication Data

US 2009/0017686 A1 Jan. 15, 2009

(30) Foreign Application Priority Data

Jul. 12, 2007 (CH) ..... 1123/07

(51) Int. Cl.
*H01R 13/66* (2006.01)

(52) U.S. Cl. ..... 439/620.1; 333/182

(58) Field of Classification Search ..... 439/620.1, 439/620.09, 607.18; 333/181–185
See application file for complete search history.

(56) References Cited

U.S. PATENT DOCUMENTS 4,408,171 A * 10/1983 Akino et al. ..... 333/177
4,700,157 A * 10/1987 Dirmeyer et al. ..... 333/185
4,760,357 A * 7/1988 Yamaguchi ..... 333/181
4,761,623 A * 8/1988 Schneider ..... 333/167
5,221,215 A * 6/1993 Tan et al. ..... 439/620.1
5,340,944 A * 8/1994 Wang ..... 174/350
5,461,351 A * 10/1995 Shusterman ..... 333/181
5,475,347 A * 12/1995 Kwak ..... 333/185
6,478,626 B2 * 11/2002 Dingenotto et al. .... 439/620.14
6,510,038 B1 * 1/2003 Satou et al. ..... 361/302
7,082,041 B2 * 7/2006 Coffey et al. ..... 363/39
7,597,590 B2 * 10/2009 McColloch ..... 439/607.18
2005/0018374 A1 * 1/2005 Anthony ..... 361/118
2009/0017686 A1 * 1/2009 Blum et al. ..... 439/620.1
2009/0093160 A1 * 4/2009 Hsieh et al. ..... 439/620.1

* cited by examiner

*Primary Examiner*—Ross N Gushi
(74) *Attorney, Agent, or Firm*—D. Peter Hochberg; Sean F. Mellino; Daniel J. Smola

(57) ABSTRACT

The present invention relates to an appliance connector device having an A plug contact, a B plug contact and a G plug contact, an A' terminal, a B' terminal and a G' terminal, an electrically conducting filter jacket and a filter module, wherein the filter module has an A" conductor, a B" conductor and a G" conductor, wherein the A contact is connected to the A' terminal via the A" conductor, wherein the B contact is connected to the B' terminal via the B" conductor, wherein the G contact is connected to the G' terminal via the G" conductor, wherein the G" conductor of the filter module has a shielding plate extending in a cross-sectional plane of the filter jacket and wherein the filter module has capacitance elements on both sides of the shielding plate with conducting surfaces aligned parallel to the shielding plate to generate capacitances between the A" conductor and the B" conductor and between these conductors and the G" conductor. With such a plug device, it is provided, in particular for improving the ground connection of the G" conductor of the filter module, that the shielding plate is provided with a plurality of contact fingers at the edge along most of its circumference, these contact fingers being in contact with the filter jacket on the inside under elastic tension, and the filter element has a contact surface for establishing a ground connection.

8 Claims, 3 Drawing Sheets

APPLIANCE CONNECTOR DEVICE WITH INTEGRATED FILTER MODULE

This application claims foreign priority based on Swiss Patent Application Serial No. 01123/07 filed Jul. 12, 2007, the content of which is incorporated herein by reference in its entirety.

BACKGROUND OF THE INVENTION

1. Field of the Invention

The present invention relates to an appliance connector device, comprising an A plug contact, a B plug contact and a G plug contact, an A terminal, a B terminal and a G terminal, an electrically conducting filter jacket and a filter module, wherein the filter module has an A conductor, a B conductor and a G conductor; wherein the A contact is connected to the A terminal via the A conductor; wherein the B contact is connected to the B terminal via the B conductor; wherein the G contact is connected to the G conductor and the G terminal; wherein the G conductor of the filter module has a shielding plate extending in a cross-sectional plane of the filter jacket; and wherein the filter module has capacitance elements on both sides of the shielding plate with conducting surfaces aligned in parallel with the shielding plate for generating capacitances between the A conductor and the B conductor and between each of these conductors and the G conductor.

2. Description of the Prior Art

Such an appliance connector device is known from US 2005/0018374. Due to the specially balanced design of the filter module of this plug device, preventing parasitic inductances, very good damping over a wide frequency range of approx. 3 MHz up to several GHz can be achieved. However, the quality of the damping depends in a sensitive manner on the ground connection of the shielding plate and the parts electrically connected to it.

With the known device, this ground connection is accomplished over several steps. First the shielding plate is connected to an electrically conducting housing of the filter module. The filter housing is in turn wrapped with an external electrically conducting shield that forms the filter jacket. The external electrically conducting shield is additionally wrapped around an internal conducting shield which is curved over a front insulating housing part that holds the plug contacts. Only this internal shield is provided with contact surfaces for contacting an electrically conducting mounting board on which the plug device can be assembled

SUMMARY OF THE INVENTION

With the known plug device, the ground connection is not optimally designed and secured in the required quality. Therefore, this invention has as its object in particular to provide an appliance connector device of the aforementioned type having a significantly improved ground connection.

This object is achieved through the features characterized in Patent Claim 1. The inventive device is thus characterized in that the shielding plate is provided on the edges along most of its circumference with a plurality of contact fingers, which are in contact with the filter jacket under an elastic stress on the inside, and the filter jacket has a contact surface for establishing a ground connection.

Due to the many contact fingers arranged along the circumference of the shielding plate, this achieves a flat ground connection that is essentially uniform on all sides between the shielding plate and the filter jacket, which can in turn be connected directly to ground. The connection by means of the contact fingers has a low resistance, so that complex soldering may be omitted, for example.

Preferred embodiments of the invention are characterized in the dependent claims.

Thus, for example, it is preferable for the G contact to be designed in one piece with the G terminal and for the shielding plate to have a plug strap at the edge through which the G contact is pushed.

The filter module preferably has metal shells on both sides of the shielding plate and connected to it electrically, with the capacitance elements arranged inside the metal shells.

One capacitance element assigned to the A conductor and one capacitance element assigned to the B conductor are preferably provided in each metal shell.

The A conductor and the B conductor are preferably designed in the form of pins and pass through the filter module at a right angle to the shielding plate.

The contacts are preferably arranged in a front insulating housing part and are held in and/or by the latter.

The filter jacket is preferably designed in the manner of a hood and is inverted over the front housing part and the rear filter module arranged behind the front housing part.

The contact surface of the filter jacket for establishing a ground connection preferably comprises a collar surface.

BRIEF DESCRIPTION OF THE DRAWINGS

The invention will now be explained in greater detail on the basis of an exemplary embodiment in conjunction with the drawing, in which.

DETAILED DESCRIPTION OF THE PREFERRED EMBODIMENTS

Figure 1A:
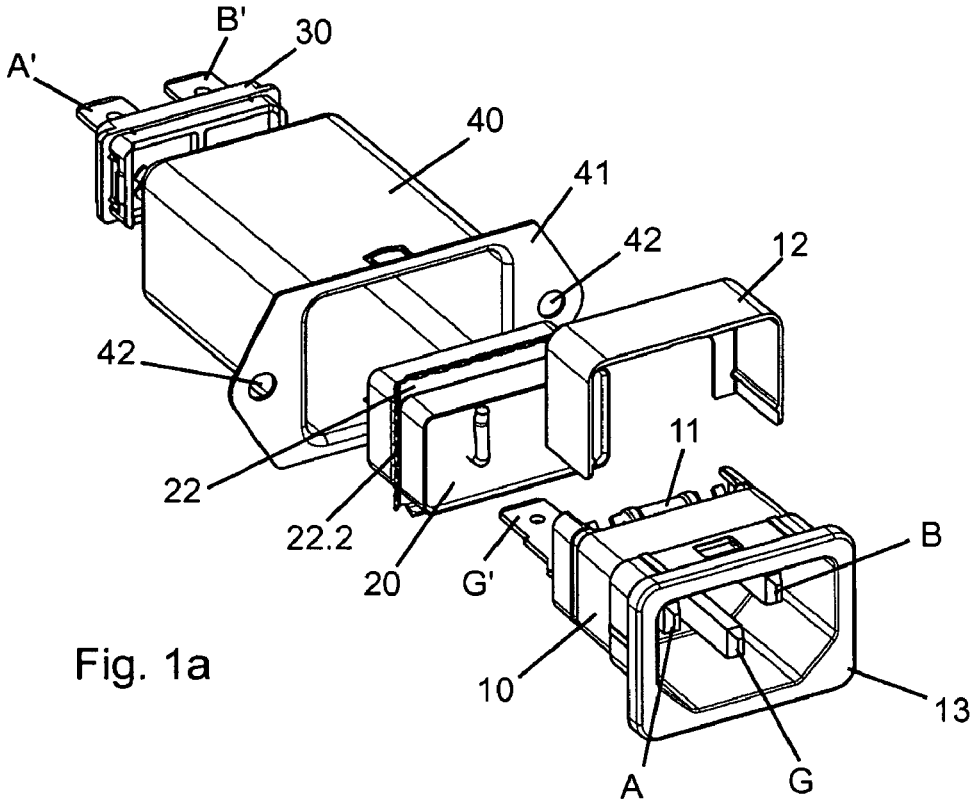
FIG. 1*a* shows a perspective exploded diagram of the front of an inventive appliance connector device.
Figure 1B:
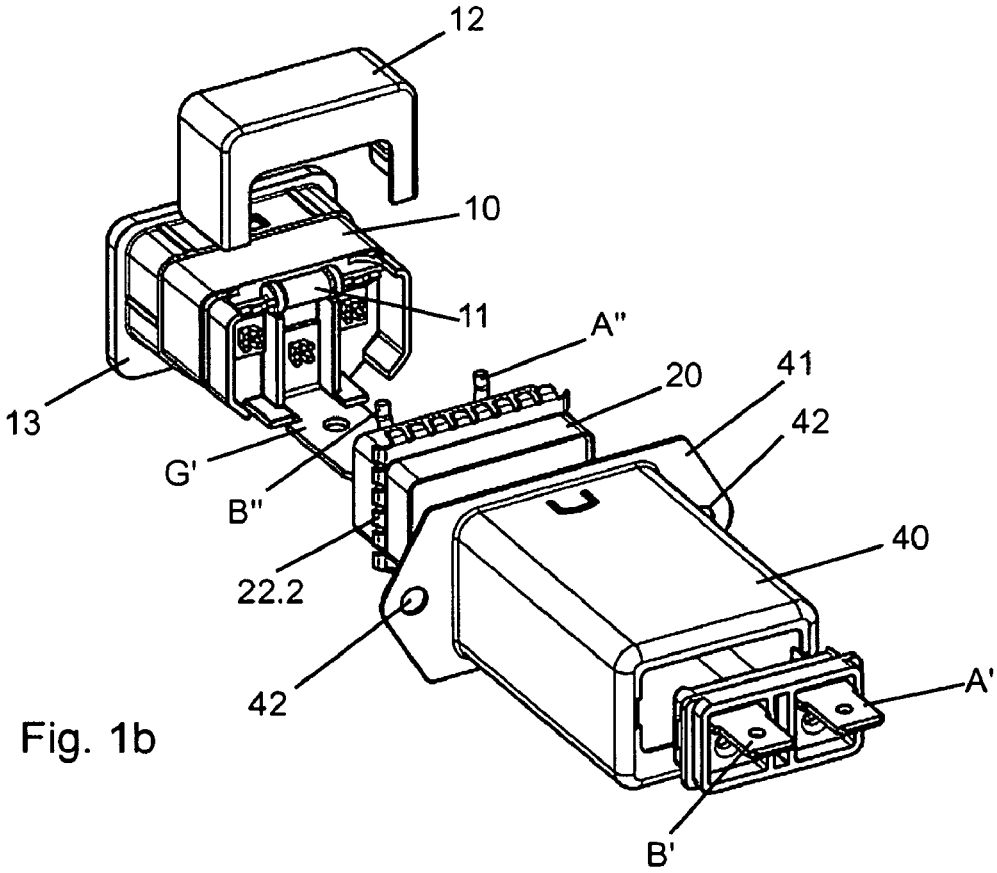
FIG. 1*b* shows a perspective exploded diagram of the rear of the inventive appliance connector device of FIG. 1*a;*
Figure 2A:
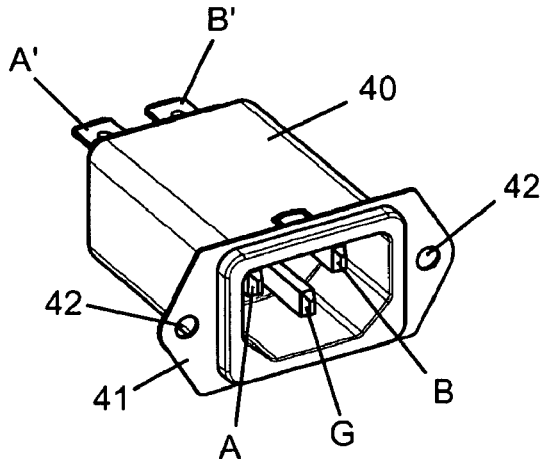
FIG. 2*a* shows a perspective view of the appliance connector device of FIG. 1*a* in the assembled state.
Figure 2B:
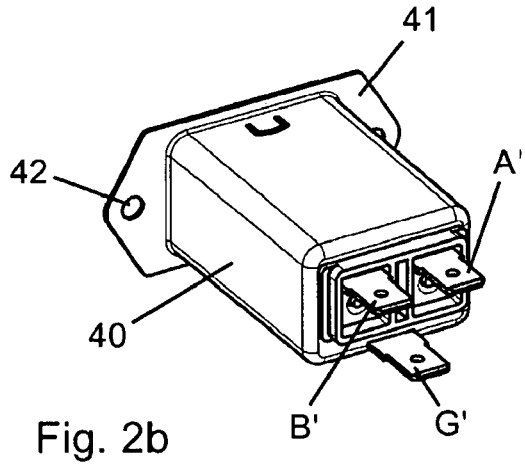
FIG. 2*b* shows a perspective view of the appliance connector device of FIG. 2*a.* in the assembled state.
Figure 3A:
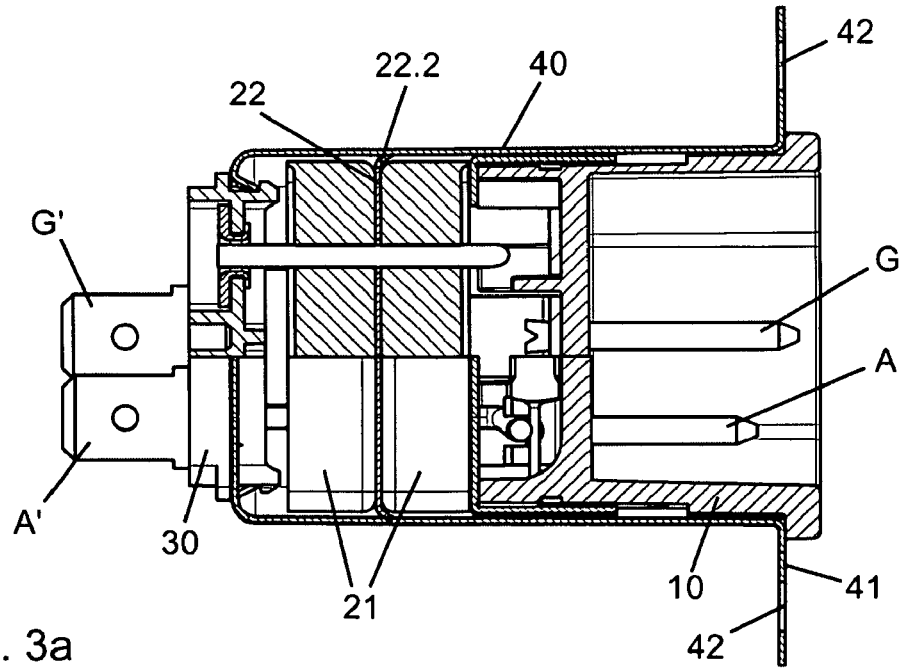
FIG. 3*a* shows a vertical section (A-A) of the appliance connector device.
Figure 3B:
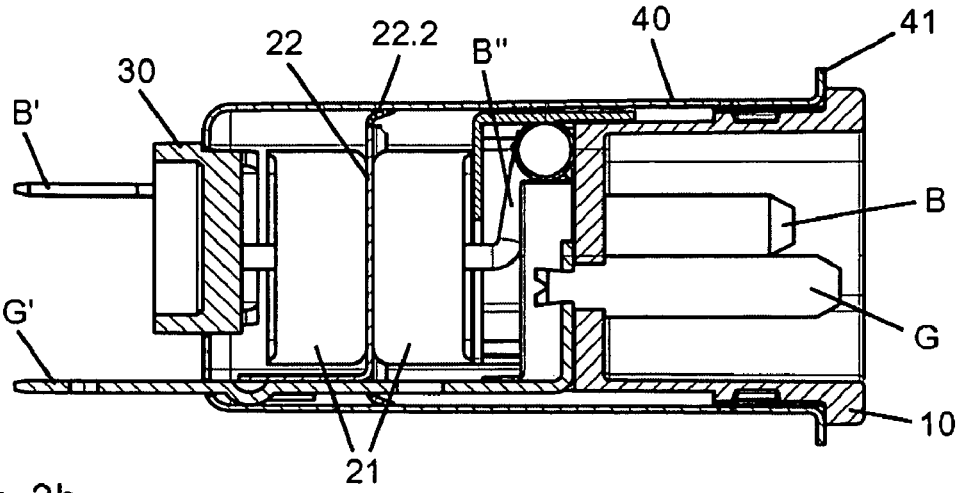
FIG. 3*b* shows a horizontal section (B-B) of the appliance connector device.

The appliance connector device shown in the figures serves to connect electric appliances to the electric alternating voltage network and is designed for an alternating voltage of 50 Hz and 230 V, for example. It has a front housing part 10 made of an insulating material with plug contacts, a filter module 20 and a rear housing part 30, again made of an insulating material, with terminal lugs. The aforementioned parts 10-30 are arranged in a filter jacket 40 made of an electrically conducting material which is designed in the manner of a hood and is inverted over the filter module 20 and the front housing part 10. The rear housing part 30 is inserted from the rear into the filter jacket 40. In the assembled state, the parts are locked together.

The front housing part 10 is designed in compliance with IEC 60320, for example, and accordingly has three plug contacts contained therein, which are labeled below as A, B and G contacts. The A and B contacts correspond to the L and N conductors, for example, and the G contact corresponds to the ground conductor of said alternating voltage network. A discharge resistor 11 is connected between the A and B conductors. A cover cap 12 made of an insulating material that can be placed onto the front housing part from the side covers the live parts carrying voltage.

The rear housing part 30 is provided with two terminal lugs, which are assigned to the plug contacts A and B and are referred to below as A' and B' terminals. A third terminal lug, hereinafter referred to as the G' terminal, is held in the front housing part 10, where it is connected to the G contact. However it extends through the filter housing 20 to the rear, passing through the rear housing part 30 and ending at the same level with the two other terminal lugs of the A' terminal and the B' terminal held therein. For example, cables may be connected to the three terminal lugs by means of cable lugs or by soldering.

Within the scope of the present invention, instead of the plug contacts, plug bushings may also be provided in the front housing part 10, and instead of the terminal lugs, other connecting devices, e.g., insulation piercing connecting devices or the like may be provided in the rear housing part 30.

The appliance connector device illustrated in the figures is provided to be assembled through insertion from the outside into an opening in an electrically conducting wall of an electric appliance in particular. The front housing part 10 as well as the filter jacket 40 each have a peripheral collar 13 and/or 41 with which they are in contact with the edge of the opening on the outside. The attachment to the wall is accomplished, e.g., by means of screws, to which end screw holes 42 are provided in the collar 41 of the filter jacket 40. The filter jacket 40 is connected in an electrically conducting manner to the wall of the electric appliance peripherally via the collar 41 as the contact surface.

The object of the filter module 20 is to filter out high-frequency interference frequencies, which enter from the alternating voltage network via an appliance cable inserted into the front housing part, and not to allow them into the electric appliance.

Figure 4A:
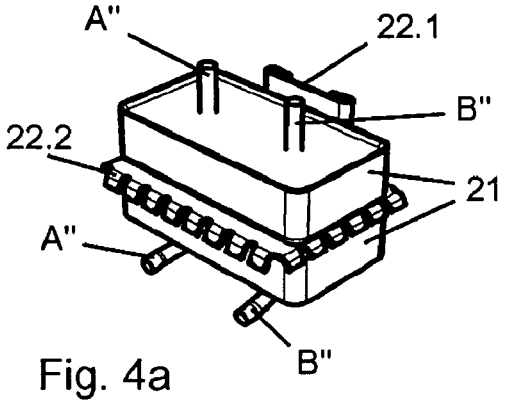
FIG. 4*a* shows a perspective view of the front of the filter module of the appliance connector device.
Figure 4B:
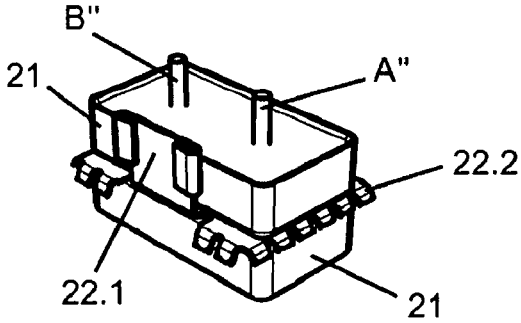
FIG. 4*b* shows a perspective view of the rear of the filter module of the appliance connector device.
Figure 5:
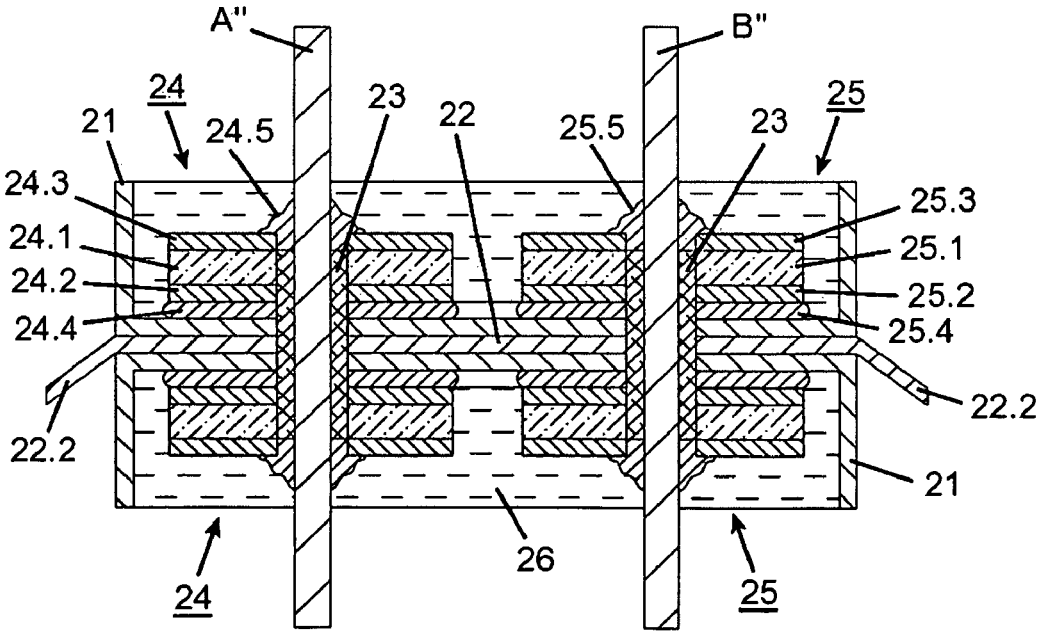
FIG. 5 shows a schematic sectional diagram of the filter module of the appliance connector device.

The filter module 20, which is shown perspectively from two sides in FIGS. 4*a* and 4*b* respectively and is diagramed schematically in a sectional showing its design in FIG. 5, has two shells 21 made of an electrically conducting material, arranged so they are facing one another with their bottom parts. A shielding plate 22 is arranged between the two shells 21 and protruding beyond them on all sides at the edges. The shielding plate 22 is also electrically conducting and is connected electrically to the two shells 21. In particular the shells 21 are soldered to the shielding plate 22. On its protruding edge, the shielding plate 22 is provided with a connector lug 22.1 and along its circumference it is also provided with a plurality of contact fingers 22.2 protruding outward at an angle and obliquely toward the rear.

The module comprising the two shells 21 and the shielding plate 22 is provided with two through-openings through which two pin-shaped conductors with insulation 23 are passed. The two conductors, one of which is referred to below as the A" conductor and the other of which is referred to as the B" conductor, do not have any electric connection to the shells 21 and the shielding plate 22. Capacitance elements 24 and 25, each having conducting surfaces aligned toward the shielding plate 22 and parallel to one another, are arranged in the two shells 21 on the two sides of a dielectric layer 24.1 and/or 25.1 to generate capacitances between the A" conductor and the B" conductor and also between these conductors and a G" conductor. The G" conductor is formed by the respective interior conducting surfaces 24.2 and/or 25.2 of the capacitance elements 24 and 25, which are electrically connected to the two shells 21, 22 and via them to the shielding plate 23 via the layers 24.4 and/or 25.4. Of the external conducting surfaces, the surfaces 24.3 are each connected to the A" conductor via solder connections 24.5 and the surfaces 25.3 are connected to the B" conductor via solder connections 25.5. Only the capacitance elements 24 and/or 25 in the upper shell 21 in FIG. 5 are labeled with the reference numerals 24.1-24.5 and/or 25.1-25.5. Finally, the two shells 21 are cast with a casting composition 26.

The filter module is preferably designed with dimensions such that the capacitance between the A" conductor and the B" conductor amounts to approximately 225-2350 pF. The capacitance between the A" conductor and the B" conductor and between the B" conductor and the G" conductor amounts to approx. 450-4700 pF.

The filter module 20 is arranged between the front housing part 10 and the rear housing part 30 in the filter housing 40, so that its shielding plate 22 lies in a cross-sectional plane of the filter jacket 40, and the contact fingers 22.2 formed on the shielding plate 22 are in contact with the inside of the filter jacket 40 and thereby establish an electrically conducting connection that is essentially flat and/or with the inside of the filter jacket on all sides. The two A" and B" conductors protrude out of the filter module 20 at the front and at the back and contact the A and B contacts on the front housing part, and contact the A' and B' terminals on the rear housing part. The A contact is thereby electrically connected to the A' terminal via the A" conductor, and the B contact is electrically connected to the B' terminal via the B" conductor. However, the G contact, as already described, is connected directly to the G' terminal. However, the terminal lug forming the G' terminal is pushed through said connector lug 22.1 on the shielding plate 22 of the filter module 20 so that the G" conductor of the filter module 20 is electrically connected to the G contact and the G' terminal.

An optimum ground connection of the filter module and therefore good filter effect up to several GHz are obtained due to the embodiment described here of the shielding plate 22 in particular and its connection to the filter jacket 40 on essentially all sides and due to its direct connection, also on all sides, to an appliance wall via the collar surface 41.

The invention claimed is:

1. Appliance connector device, comprising:

an A plug contact, a B plug contact and a G plug contact;

an A' terminal, a B' terminal and a G' terminal;

an electrically conducting filter jacket having an inside, a cross-sectional plane and a contact surface for establishing a ground connection; and a filter module having at least one conducting surface, said filter module including:

an A" conductor for connecting the A' terminal to the A plug contact;

a B" conductor for connecting the B' terminal to the B plug contact; and a G" conductor for connecting the G' terminal to the G plug contact, said G" conductor of the filter module including a shielding plate, said shielding plate having:

at least one edge, a circumference, an inside, two sides and a plurality of contact fingers on the edge along most of its circumference, the contact fingers being in contact with the filter jacket on the inside under elastic tension;

said shielding plate extending in the cross-sectional plane of the filter jacket;

wherein the filter module has capacitance elements on both sides of the shielding plate with the at least one conducting surface aligned parallel to the shielding plate to create capacitances between the A" conductor and the B" conductor and between A" conductor, the B" conductor and the G" conductor.

2. Appliance connector device according to claim 1, wherein the G contact is connected directly to the G' terminal, and the shielding plate further includes a connector lug at the edge of the shielding plate through which the G' terminal is plugged.

3. Appliance connector device according to claim 1, wherein the filter module has electrically conducting shells on both sides of the shielding plate that are electrically connected thereto, the capacitance elements being arranged in the shells.

4. Appliance connector device according to claim 3, wherein one of said capacitance elements assigned to the A" conductor and to the B" conductor is provided in each shell.

5. Appliance connector device according to claim 3, wherein the A" conductor and the B" conductor are designed in the form of pins and are passed through the filter module at a right angle to the shielding plate.

6. Appliance connector device according to claim 1, wherein the A plug contact, the B plug contact and the C plug contact are arranged and held in a front insulating housing part.

7. Appliance connector device according to claim 6, wherein the filter jacket forms a hood inverted over the front insulating housing part and the filter module arranged behind the front housing part.

8. Appliance connector device according to claim 7, wherein the contact surface of the filter jacket comprises a collar surface to establish a ground connection.

* * * * *